US007043192B2

(12) United States Patent
Terao et al.

(10) Patent No.: US 7,043,192 B2
(45) Date of Patent: May 9, 2006

(54) SHEET POST-PROCESS APPARATUS AND WAITING TRAY

(75) Inventors: Yasunobu Terao, Tagata-gun (JP); Yoshiaki Sugizaki, Sunto-gun (JP); Tomomi Iijima, Mishima (JP); Tokihiko Ise, Tagata-gun (JP); Hiroyuki Taki, Tagata-gun (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/008,124

(22) Filed: Dec. 10, 2004

(65) Prior Publication Data

US 2006/0067762 A1 Mar. 30, 2006

(30) Foreign Application Priority Data

Sep. 28, 2004 (JP) ..... 2004-281779

(51) Int. Cl.
*G03G 15/00* (2006.01)

(52) U.S. Cl. ..... 399/407; 399/408; 399/410; 270/37; 270/58.08

(58) Field of Classification Search ..... 399/407, 399/408, 409, 410; 270/37, 58.08, 52.18
See application file for complete search history.

(56) References Cited

U.S. PATENT DOCUMENTS 5,021,837 A 6/1991 Uto et al.
5,709,376 A * 1/1998 Ushirogata ..... 270/58.11
6,231,039 B1 5/2001 Chung
6,330,999 B1 12/2001 Coombs et al.
6,450,934 B1 9/2002 Coombs
6,641,129 B1 * 11/2003 Ogita et al. ..... 270/58.08
6,671,492 B1 * 12/2003 Mimura et al. ..... 399/407
6,698,744 B1 * 3/2004 Yamada et al. ..... 270/58.12
6,712,349 B1 * 3/2004 Watanabe ..... 270/37
6,722,646 B1 4/2004 Sekiyama et al.
6,733,006 B1 * 5/2004 Kobayashi et al. ..... 270/37
6,819,906 B1 * 11/2004 Herrmann et al. ..... 399/368
6,824,128 B1 * 11/2004 Nagata et al. ..... 270/58.08
2004/0126163 A1 7/2004 Asami et al.
2005/0000336 A1 1/2005 Hattori et al.

FOREIGN PATENT DOCUMENTS

JP 62-008965 1/1987
JP 2583594 B2 11/1996
JP 2002-060118 A 2/2002

* cited by examiner

*Primary Examiner*—Andrew H. Hirshfeld
*Assistant Examiner*—Dave A. Ghatt
(74) *Attorney, Agent, or Firm*—Foley & Lardner LLP

(57) ABSTRACT

A rotary shaft is allocated in association with a distal end face in a transport direction of a sheet retained on a waiting tray in a waiting mode. On this rotary shaft, a distal end lower face support member, an upper face slash member, and a sheet alignment paddle member are coaxially mounted. Then, by rotating the rotary shaft, standby retention, support release, and sheet alignment processes are carried out in order with respect to the sheet on the waiting tray.

9 Claims, 14 Drawing Sheets

SHEET POST-PROCESS APPARATUS AND WAITING TRAY

CROSS-REFERENCE TO RELATED APPLICATIONS

This application is based upon and claims the benefit of priority from prior Japanese Patent Application No. 2004-281779, filed Sep. 28, 2004, the entire contents of which are incorporated herein by reference.

BACKGROUND OF THE INVENTION

1. Field of the Invention

The present invention relates to an apparatus (finisher) for bundling sheets sent from an image forming apparatus, thereby carrying out, for example, staple processing and a waiting tray for use in the post-process apparatus.

2. Description of the Related Art

A post-process apparatus comprises: a processing tray for bundling sheets sent from an image forming apparatus, thereby carrying out, for example, staple processing, and ejecting the processed bundles of sheets; and a storage tray for holding the ejected bundles of sheets. A staple processing speed of the post-process apparatus is slow as compared with an image processing speed of the image forming apparatus. Thus, if a sheet is directly sent to the processing tray, a sheet to be staple processed next is transported while a preceding sheet is staple processed. In order to prevent this problem, conventionally, a buffer mechanism for adjusting a carrying-in timing of a sheet at a front stage of the processing tray is proposed.

Japanese Patent Document 1: Japanese Patent No. 2583594 discloses a mechanism for retaining sheets is provided at a transport passage for sending sheets sent from an image forming apparatus to a processing tray. However, in this case, there is a need for increasing the transport passage in length, and, as a result, the post-process apparatus is likely to be large in size.

Japanese patent document 2: Jpn. Pat. Appln. KOKAI Publication No. 2002-60118 discloses a mechanism comprising an arm for flicking a sheet onto a transport belt and a paddle for abutting a distal end of the sheet held on the transport belt against a push-out claw formed on the transport belt to align the distal end of the sheet. However, in this mechanism, the arm, the push-out claw and the like are provided independently, and they are not mounted on one rotary shaft.

BRIEF SUMMARY OF THE INVENTION

The Inventors proposes here that a waiting tray is newly allocated as a buffer mechanism at an upper stage of a processing tray. The waiting tray according to this proposal is allocated to be proximal to the upper stage of the processing tray, and a sheet transported from an image forming apparatus to the processing tray is temporarily retained here in a waiting mode. At a time point when retention in a waiting mode is released, that is, at a time point when staple processing of a bundle of sheets at the processing tray terminates, and then, the bundle of sheets is transported from the processing tray to a storage tray, the sheet is supported on a bottom face of the waiting tray. By opening this tray, the sheet is then dropped at the distal end side (upstream side when the sheet is transported to the waiting tray) to the processing tray. By using this waiting tray, equipment can be allocated with a simple mechanism without a need to increase a transport passage in length and providing a space. As a result, a post-process apparatus can be made compact. Moreover, it is possible to sent the sheets to the processing tray without any malfunction.

However, when a sheet is dropped from the waiting tray onto the processing tray, if such dropping is prolonged and an unstable sheet floating state is prolonged, the sheet is not held in a proper location of the processing tray. As a result, alignment of the bundles of sheets held on the processing tray is likely to be unreliable and unstable. Therefore, it is important to reduce such a sheet floating unstable state to the minimum, and then, establish a stable state in which the sheet is held on the processing tray within a short period of time.

It is an object of the present invention to reduce the unstable sheet floating state to the minimum with respect to a sheet released from the support on the waiting tray to establish the stable state in which the sheet is held on the processing tray within a short period of time. It is another object of the present invention to provide a sheet post-process apparatus and a waiting tray capable of reliably carrying out sheet processing on the processing tray speedily and reliably, for example, alignment processing of the distal end in the sheet transport direction, by establishing the above stable state.

In order to solve the above described problem, the present invention comprises the following features.

1. A sheet post-process apparatus, the apparatus comprising:

a waiting tray which temporarily retains a transported sheet in a waiting mode, and releases the retention to drop the sheet;

a processing tray which bundles sheets dropped from the waiting tray to carry out predetermined processing, and ejects the sheets; and a storage tray which holds the bundle of sheets processed and ejected on the processing tray, wherein the waiting tray comprises:

left and right lower face support members which support left and right lower faces in a sheet transport direction during retention in a waiting mode and release the support of the left and right lower faces during release of the retention;

a distal end lower face support member which supports a distal end lower face in a sheet transport direction during retention in a waiting mode and releases the support of the sheet distal end during release of the retention;

an upper face slash member which slashes a sheet distal end upper face in a processing tray direction during release of the retention; and a rotary shaft allocated in association with the distal end face in the transport direction of the sheet retained in a waiting mode, and the rotary shaft coaxially mounts the distal end upper face support member and the upper face slash member, and rotates the members, thereby moving the distal end lower face support member from a location for retention in a waiting mode to a location for releasing the retention and moving the upper face slash member to a location for slashing the sheet distal end upper face in the processing tray direction.

2. A sheet post-process apparatus according to 1, wherein the waiting tray further comprises an alignment paddle member which aligns a distal end of sheets held on the processing tray during sheet alignment on the processing tray, and the rotary shaft coaxially mounts the paddle member together with the distal end lower face support member and the upper face slash member, and rotates the members, thereby moving the distal end lower face support member from a location for retention in a waiting mode to a location for releasing the support and moving the upper face slash member to a location for slashing the sheet distal end upper face in the processing tray direction, and then moving the paddle member to a location for aligning the sheets.

3. A sheet post-process apparatus according to 1, wherein the waiting tray is allocated to be proximal to an upper stage of the processing tray, the processing tray and the waiting tray are allocated in an inclined shape which is high at a proximal end side of a sheet to be transported and which is low at a distal end side thereof, the processing tray and the waiting tray are short in length of a sheet transport direction thereof than a length of a standard sheet to be held, and a part of the proximal end side in the transport direction of the sheet held on the processing tray is held on the storage tray.

4. A waiting tray for use in a sheet post-process apparatus, for temporarily retaining a transported sheet in a waiting mode and releasing the support to drop the sheet onto a processing tray, the waiting tray comprising:

left and right lower face support members which support left and right lower faces in a sheet transport direction during retention in a waiting mode and release the support of the left and right lower faces during release of the retention;

a distal end lower face support member which supports a distal end lower face in a sheet transport direction during retention in a waiting mode and releases the support of the sheet distal end during release of the retention;

an upper face slash member which slashes a sheet distal end upper face in a processing tray direction during release of the retention; and a rotary shaft allocated in association with a distal end face in the transport direction of a sheet retained in a waiting mode, and the rotary shaft coaxially mounts the distal end upper face support member and the upper face slash member, and rotates the members, thereby moving the distal end lower face support member from a location for retention in a waiting mode to a location for releasing the retention and moving the upper face slash member to a location for slashing the sheet distal end upper face in the processing tray direction.

5. A waiting tray according to 4, further comprising: an alignment paddle member for aligning a distal end of sheets held on a processing tray during sheet alignment on the processing tray;

wherein the rotary shaft coaxially mount a paddle member together with the distal end lower face support member and the upper face slash member, and rotates the members, thereby moving the distal end lower face support member from a location for retention in a waiting mode to a location for releasing the support and moving the upper face slash member to a location for slashing the sheet distal end upper face in the processing tray direction, and then, moving the paddle member to a location for aligning the sheets, and then moving the paddle member to a location for aligning the sheets.

6. A waiting tray according to 4, wherein the upper face slash member is made of a soft elastic member.

7. A waiting tray according to 5, wherein the paddle member is made of a soft elastic member, and in a location for aligning a sheet dropped onto the processing tray, the paddle member comes into contact with the upper face of the sheet in an elastically curved state, and aligns a distal end of the sheet to be pushed against a distal end side opposite to the transport direction.

8. A sheet post-process apparatus, the apparatus comprising:

waiting means for temporarily retaining a transported sheet in a waiting mode, and releasing the retention to drop the sheet;

processing means for bundling sheets dropped from the waiting means to carry out predetermined processing, and ejecting the sheets; and storage means for holding the bundle of sheets processed and ejected on the processing means, wherein the waiting means comprises:

left and right lower face support means for supporting left and right lower faces in a sheet transport direction during retention in a waiting mode and releasing the support of the left and right lower faces during release of the retention;

distal end lower face support means for supporting a distal end lower face in a sheet transport direction during retention in a waiting mode and releasing the support of a sheet distal end during release of the retention;

upper face slash means for slashing a sheet distal end upper face in a processing means direction during release of the retention; and a rotary shaft allocated in association with a distal end face in the transport direction of a sheet retained in a waiting mode, and the rotary shaft coaxially mounts the distal end upper face support means and the upper face slash means, and rotates the means, thereby moving the distal end lower face support means from a location for retention in a waiting mode to a location for releasing the retention and moving the upper face slash means to a location for slashing the sheet distal end upper face in the processing means direction.

9. A sheet post-process apparatus according to 8, wherein the waiting means further comprises alignment means for aligning a distal end of sheets held on the processing means during sheet alignment on the processing means, and the rotary shaft coaxially mounts the alignment means together with the distal end lower face support means and the upper face slash means, and rotates the means, thereby moving the distal end lower face support means from a location for retention in a waiting mode to a location for releasing the support and moving the upper face slash means to a location for slashing the sheet distal end upper face in the processing means direction, and then, moving the alignment means to a location for aligning the sheets.

In the present specification and claims, a proximal end side, a distal end side, and a sheet width are defined as follows. That is, when a transport direction of a sheet to be transported to a waiting tray is defined as a reference, a downstream side in the transport direction is defined as a proximal end side; an upstream side in the transport direction is defined as a distal end side; and a length in a transverse direction when the sheet transport direction is defined as a longitudinal direction is defined as a sheet width. In addition, a sheet denotes a copy sheet on which a toner image (developed image) is copied and which is sent from the image forming apparatus.

According to the present invention, a distal end lower face support member for supporting a distal end lower face in a transport direction of a sheet retained in a waiting mode is provided together with left and right lower face support members for supporting left and right lower faces in the transport direction of the sheet retained on the waiting tray in a waiting mode. Thus, even if the sheet to be retained on the waiting tray in a waiting mode is easily bent, the sheet can be prevented from accidentally slipping off from the waiting tray onto the processing tray.

Further, after retention in a waiting mode has been released, when the sheet is dropped from the waiting tray to the processing tray, retention of the left and right lower face support members is released, and at the same time, retention of the distal end lower face support member is released. During this release of the retention, the upper face of the sheet distal end portion is slashed by a slash member, whereby this sheet is forcibly dropped from the distal end side to the processing tray. As a result, the proximal end side of the sheet is located at its upper side during dropping; the distal end side of the sheet is located at its lower side, and the sheet is first dropped from the distal end side to the processing tray. By forcibly dropping the sheet, a stable state in which the sheet is held on the processing tray can be established within a short period of time. In addition, the sheet is dropped from the distal end side, whereby the sheet can be dropped with good posture and the alignment property of the sheet distal end portion is improved.

Next, the paddle member pulls the distal end of the sheet toward the distal end side of the processing tray while retaining the upper face of the sheet forcibly dropped and held on the processing tray. Thus, the sheet distal end can be aligned.

In addition, according to the present invention, the distal end retainer member, slash member, and paddle member (or the distal end retainer member and slash member) are coaxially attached. Thus, equipment is simplified, and these members can be driven by one drive source. As a result, equipment can be made inexpensive and compact.

The distal end retainer member is made of a resin, whereby a sheet can be stably dropped without being caught. Since the slash member is made of a soft rubber or the like, even if a sheet is slashed at a high rotation speed, the sheet is not damaged. The paddle member is formed in an arm shape and is made of a soft rubber or the like, whereby the paddle can be significantly slackened. Therefore, the sheet distal end can be stably pulled (aligned) regardless of the number of sheets held on the processing tray. Further, even if there is a portion at which a mechanism is dense (for example, allocation of a rotating shaft), the paddle member is slacked and released, thus, enabling packaging without particularly considering allocation of these members.

DETAILED DESCRIPTION OF THE INVENTION

<Waiting Tray>

Figure 1:
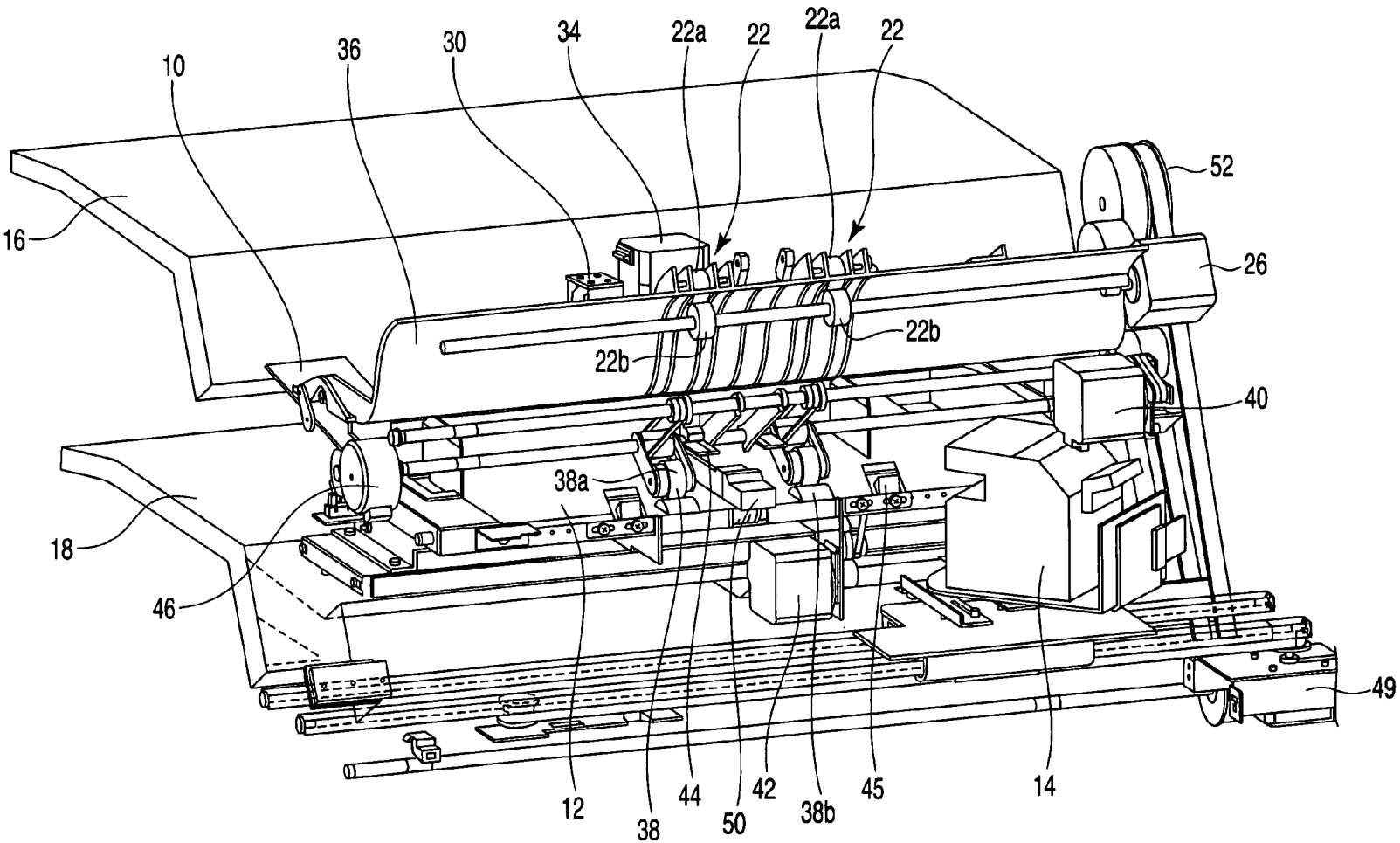
FIG. 1 is a perspective view of a post-process apparatus showing one embodiment of the present invention.
Figure 2:
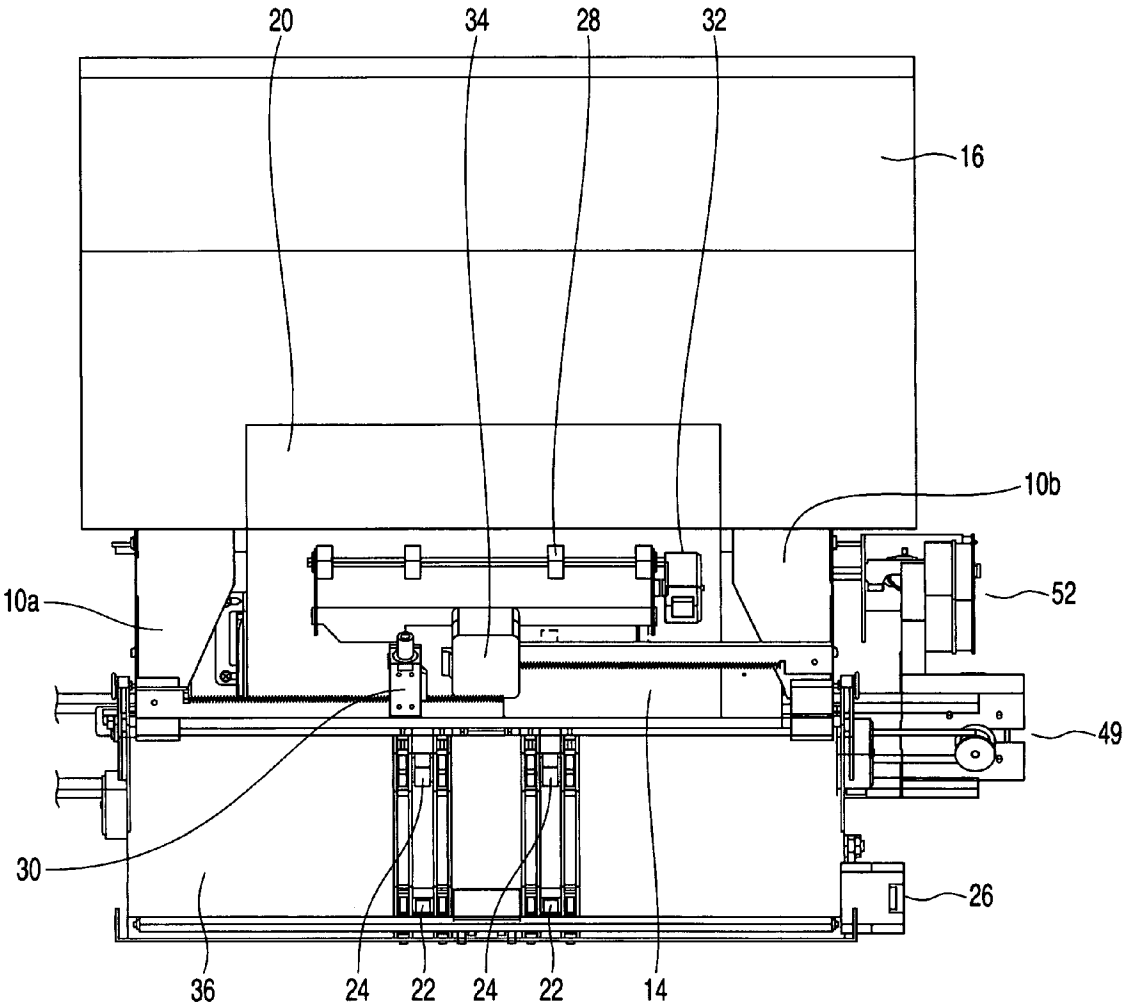
FIG. 2 is a top view of the post-process apparatus showing one embodiment of the invention.
Figure 3:
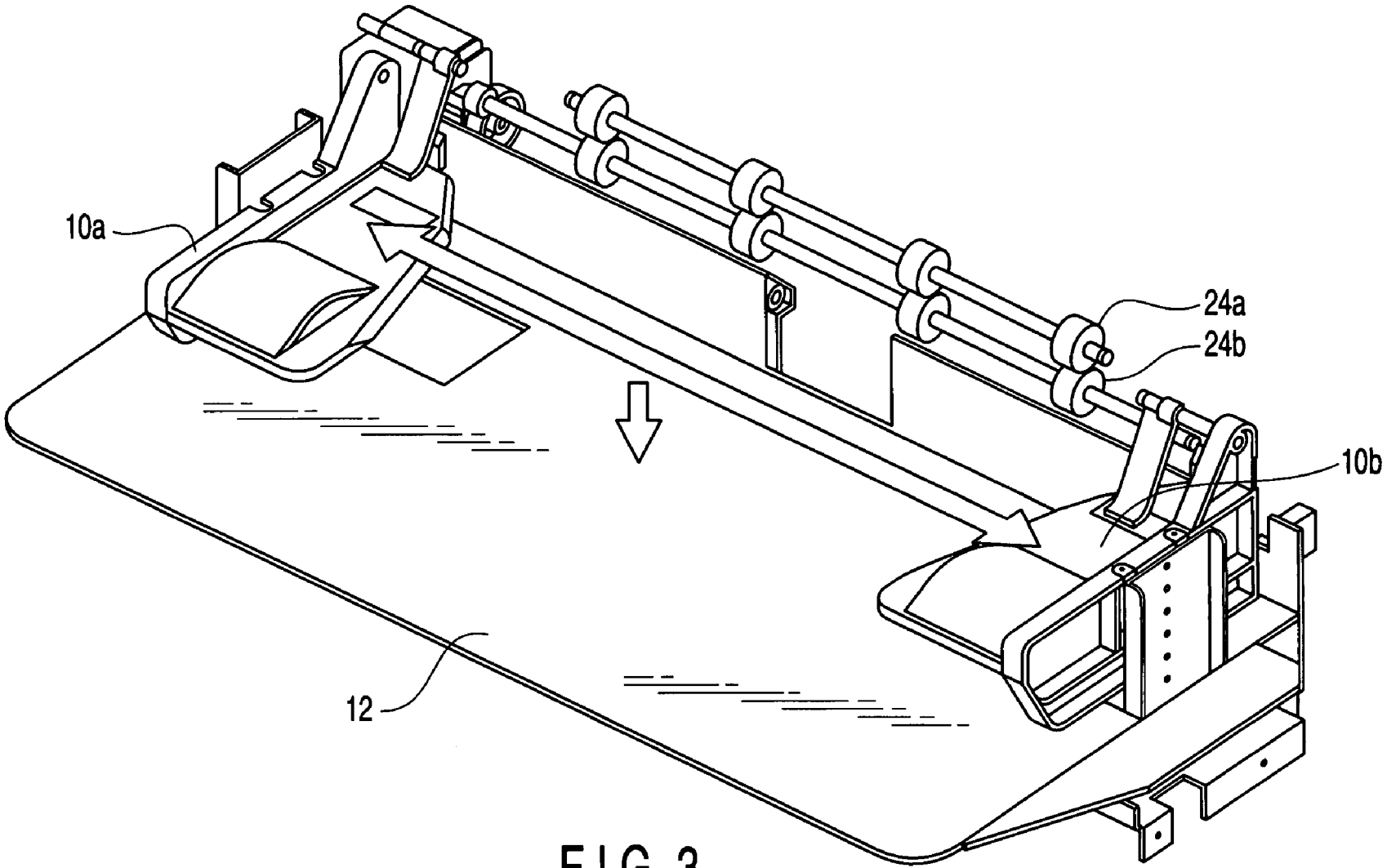
FIG. 3 is a view illustrating an operation of a waiting tray showing one embodiment of the invention.

The waiting tray will be described in detail with reference to FIGS. 1, 2 and 3. As has been already described, when a preceding sheet is staple processed on the processing tray 12, a next sheet cannot be dropped on the processing tray. The waiting tray 10 is intended for make the next sheet standby in this state. The inlet roller 22 includes an upper inlet roller 22*a* and a lower inlet roller 22*b*. These rollers are driven by an inlet roller motor 26. The paper feed roller 24 includes an upper paper feed roller 24*a* and a lower paper feed roller 24*b*. These rollers are driven by a paper feed roller motor. The waiting tray roller 28 can be operated to be vertically elevated. This operation is controlled by a waiting tray roller drive source 30. The waiting tray roller 28 enables normal and invert rotation. This normal and invert rotation is carried out by a waiting tray roller motor 32.

On the waiting tray 10, left and right lower face support members 10*a* and 10*b* for supporting both sides of the lower face of a sheet carried into the waiting tray are provided in the left and right widthwise direction. A space between the left and right lower face support members is open. Therefore, a center section of the sheet lower face is not supported. The upper faces of these left and right lower face support members 10*a* and 10*b* each are formed in a flat shape, and a curved face which is upwardly curved is formed at its top end side. Instead of this curved face or together with the curved face, a roller which is rotatable in an arbitrary direction may be engaged. The left and right lower face support members 10*a* and 10*b* are formed to be wide in width at a proximal end side thereof and to be narrow in width at a distal end side thereof. As a result, the width of the opening portion formed between the lower face support members is wide at the proximal end and narrow at the distal end side. The width used here denotes a transverse direction in the case where the sheet transport direction is defined as a longitudinal direction. The left and right lower face support members 10*a* and 10*b* are set in location in which a sheet side face can be supported fully on the left and right lower face support members when a sheet is retained in a waiting mode. On the other hand, The left and right lower face support members 10*a* and 10*b* are set in location in which these support members are released when the support of the sheet is released. When the left and right lower face support members 10*a* and 10*b* are set in this location, the sheet can be dropped from the distal end thereof on the processing tray 12. The left and right lower face support members 10*a* and 10*b* are driven by a waiting tray motor 34 drive motor (not shown). By this waiting tray motor 34, the left and right lower face support members 10*a* and 10*b* are slid to adjust the opening width of the opening portion, thereby opening and closing the left and right lower face support members 10*a* and 10*b*.

The waiting tray roller 28 returns the sheet transported to the waiting tray to the distal end side, and aligns the sheet distal end by abutting the sheet distal end against a distal end 60 of the waiting tray. In this case, although the sheets are located upwardly when they are transported to the waiting tray, the roller is lowered in the case where the sheet distal end is aligned. Then, the sheets are rotated while the sheets are compressed, and the sheets are pushed back. In addition, also in the case where the sheets are transported from the waiting tray directly to the storage tray, the waiting roller is lowered and is rotated while the sheets are compressed, and the sheets are ejected. In this case, the rotation direction of the waiting tray roller 28 becomes inverted from that in the case where the sheets are abutted against the distal end side.

Figure 18:
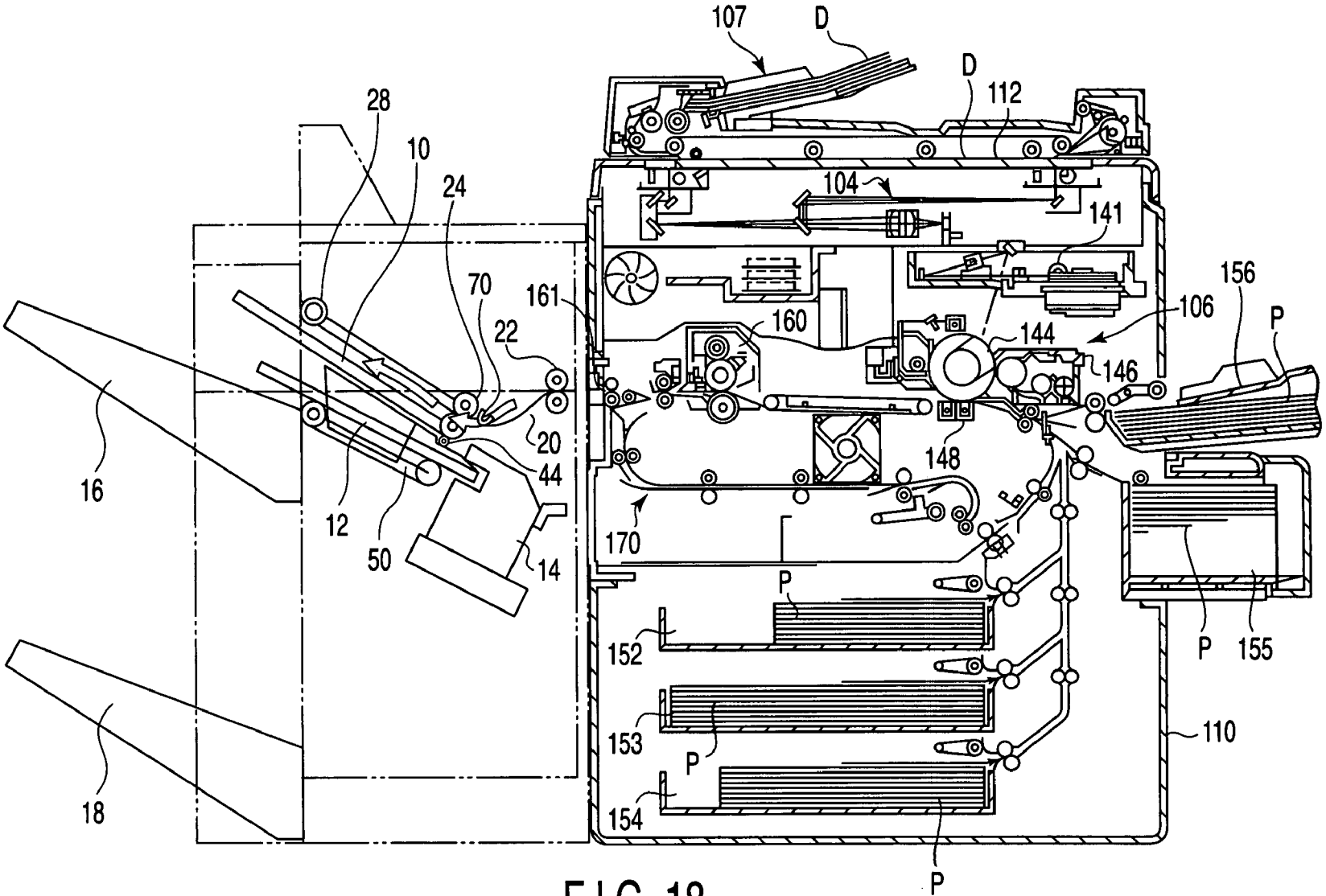
FIG. 18 is a view showing a combination of the post-process apparatus and the image forming apparatus according to the present invention.

On the waiting tray 10, there is provided the sheet sensor 70 (refer to FIG. 18 or the like) for sensing a sheet to be proximal to the paper feed roller 24, i.e., at a side (upstream side) at which a sheet is carried in the waiting tray. This sheet sensor 70 senses the start of transport (sheet proximal end) by the paper feed roller 24 and the end of transport (sheet distal end) by the sheer feed roller 24. This sense signal is fed to control means.

Figure 19:
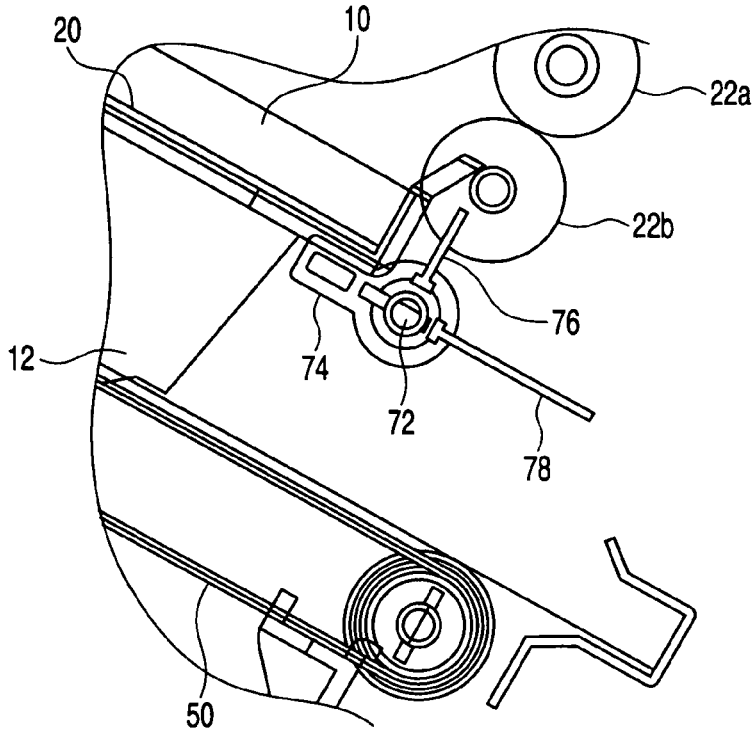
FIG. 19 is a view showing actuation of the waiting tray showing one embodiment of the present invention, the view showing a state in which a distal end retainer member retains a sheet distal end.
Figure 20:
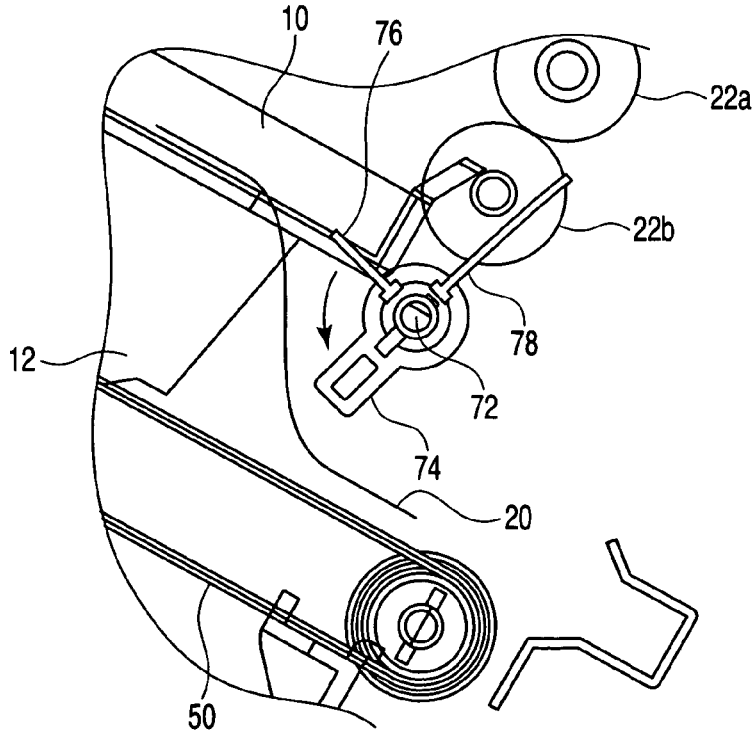
FIG. 20 is a view showing actuation of the waiting tray showing one embodiment of the present invention, the view showing a state in which an upper face slash member slashes a sheet distal end upper face.
Figure 21:
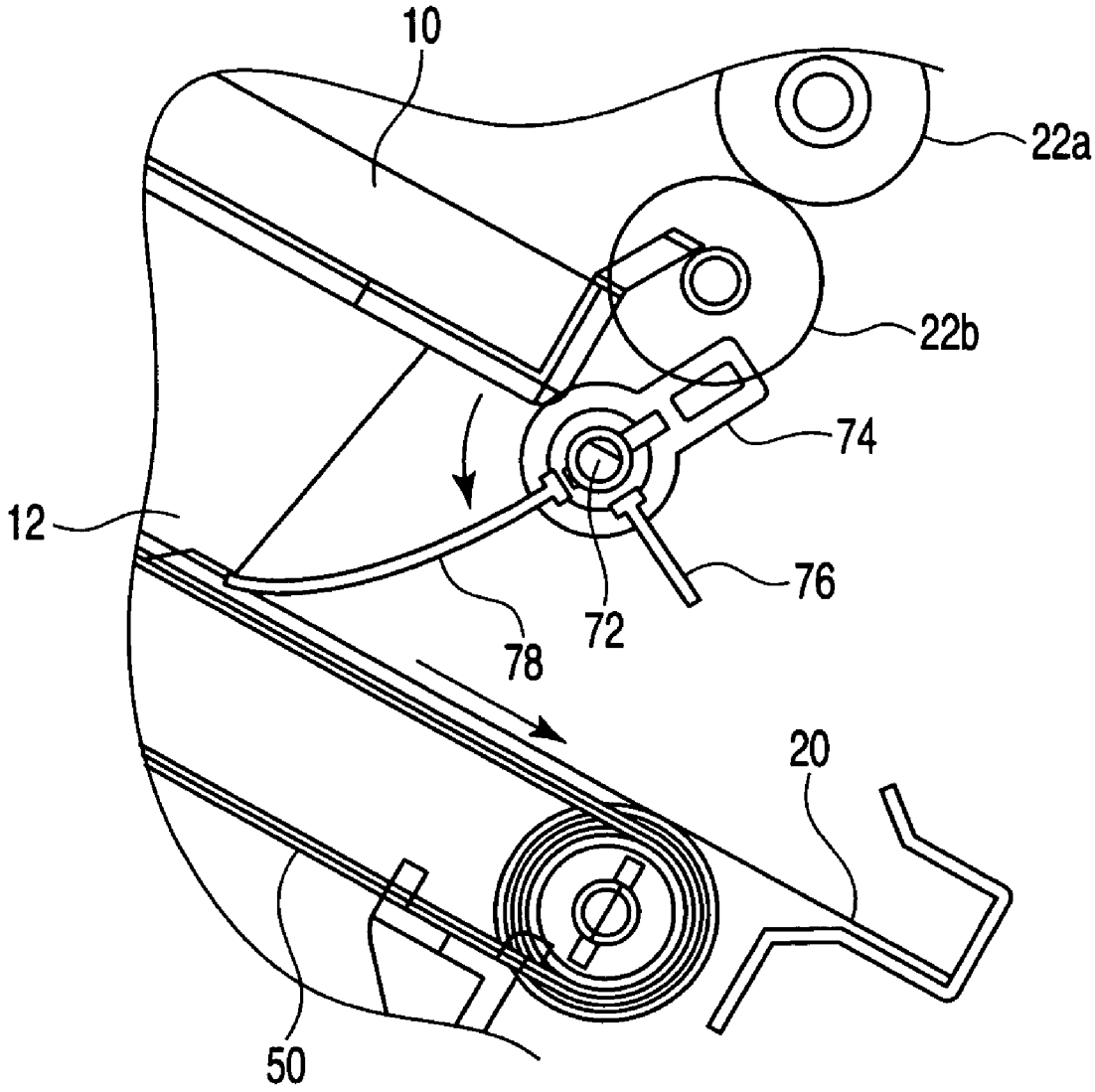
FIG. 21 is a view showing actuation of the waiting tray showing one embodiment of the present invention, the view showing a state in which a sheet distal end is aligned by a paddle member.

FIGS. 19 to 21 are enlarged views each showing a rear side of the waiting tray 10. Below the inlet roller 22, a rotary shaft 72 is arranged along the distal end face of a sheet to be retained in a waiting mode. On this rotary shaft 72, a distal end lower face support member 74, an upper face slash member 76, and a paddle member 78 are coaxially allocated to be projected in a peripheral direction with predetermined intervals. (In this example, the distal end lower face support member 74 and the upper face slash member 76 are allocated in order with an interval at an angle of 90 degrees, and the upper face slash member 76 and the paddle member 78 are allocated in order at an angle of 90 degrees). When the sheet is retained in a waiting mode, the distal end lower face support member 74 is set in a location for supporting a sheet distal end lower face (preferably, a center portion thereof) as shown in FIG. 19. On the other hand, when retention of the sheet is released, this support member is moved in a downward direction as shown in FIG. 20 so as to release the support of the distal end lower face. This distal end lower face support member is made of a resin or the like. The upper face slash member 76 is located upwardly to be spaced from the sheet during retention in a waiting mode. However, when the retention is released, as shown in FIG. 20, this slash member rotates downwardly as shown in FIG. 20, and stashes the sheet upper face so as to forcibly drop the sheet onto the processing tray 12. This upper face slash member 76 is made of a soft rubber or the like. The alignment paddle member 78 carries out alignment processing of the distal end in the transport direction of the sheet dropped on the processing tray 12. This paddle member is located at the opposite side of the distal end lower face support member 74 while in retention in a waiting modem and is located above the sheet while in release of the retention. Further, when sheet alignment processing shown in FIG. 21 is carried out such that the rotary shaft is rotated at 180 degrees from the standby retention state, the paddle member comes into contact with the sheet upper face held on the processing tray 12 in a curved state. Then, the sheet is pushed down to the distal end side, and the sheet is aligned with the distal end in the transport direction. This paddle member 78 is made of a soft rubber, and has a sufficient length to come into contact with the sheet upper face on the processing tray in a curved state. The paddle member 12 is made of a soft rubber or the like. Thus, even if the paddle member comes into contact with another device (for example, the drive shaft of the paper feed roller) of the post-process apparatus during rotation, the paddle member is curved to avoid this, and such another device is not damaged. In addition, rotation of the paddle member is not adversely affected. When such a sheet alignment process terminates, the rotary shaft 72 returns to its original location for the distal end lower face support member 74 shown in FIG. 19 retains the sheet lower face.

In the present embodiment, although the upper face slash member 76 and the paddle member 78 are provided on the rotary shaft 72 together with the distal end retainer member 74, the present invention includes a structure in which the paddle member is not provided. In this case, the invention may employ, for example, a structure in which two sets of distal end retainer members and upper face slash members are combined, that is, a structure in which a first distal end retainer member, a first upper face slash member, a second distal end retainer member, and a second upper face slash member are allocated on the rotary shaft 72 in a cross shape at an angle of 90 degrees. In this structure, the rotary shaft is returned to its original location by rotating it at 180 degrees.

<Processing Tray>

The processing tray 12 carries out longitudinal or transverse alignment with respect to bundles of sheets dropped from the waiting tray 10, and carries out predetermined processing (for example, staple processing). This processing tray is allocated in a inclined shape which is high at the proximal end side and which is low at the distal end side.

Figure 4:
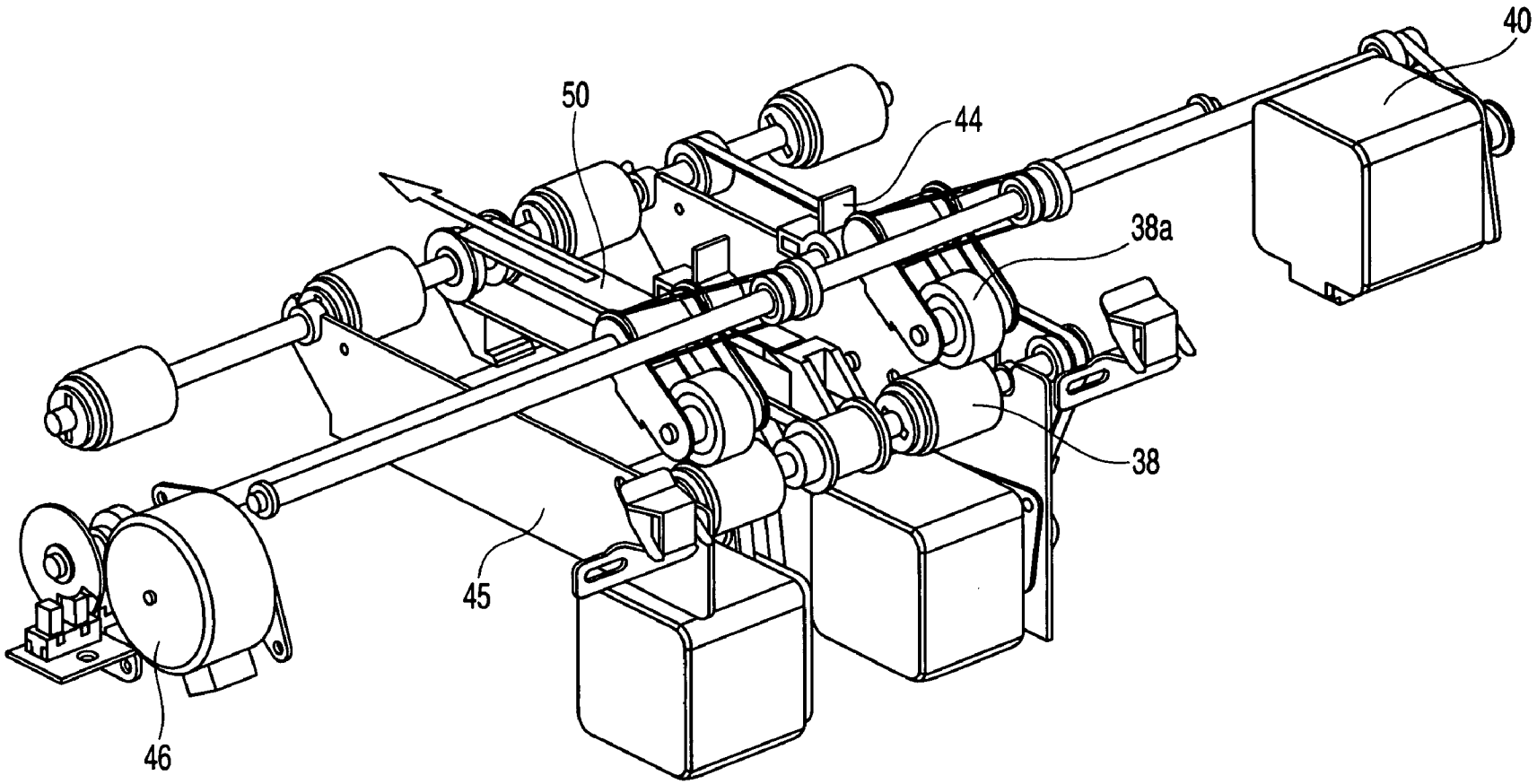
FIG. 4 is a view illustrating a longitudinal alignment and sheet bundle transport mechanism of the post-process apparatus showing one embodiment of the invention.

As shown in FIG. 4, longitudinal alignment is carried out by a longitudinal alignment roller 38. A longitudinal alignment upper roller 38*a* is driven by a longitudinal alignment upper roller motor 40. A longitudinal alignment lower roller 38*b* is driven by a longitudinal alignment lower roller motor 42. Sheets are aligned while a stopper 45 is defined as a reference. In addition, in order to assist this alignment, a paddle 44 is provided. This paddle 44 is driven by a paddle motor 46.

Figure 5:
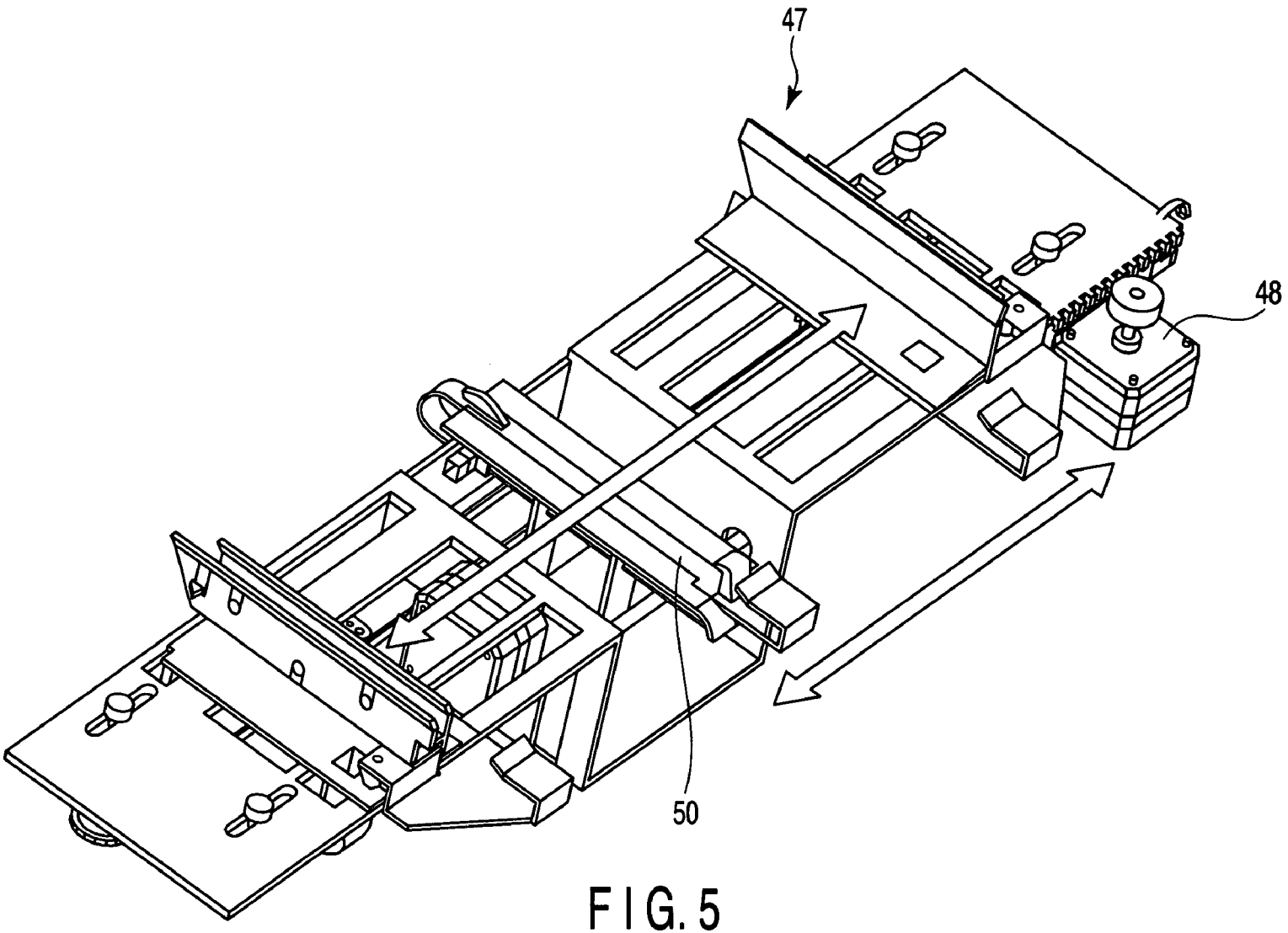
FIG. 5 is a view illustrating a transverse alignment mechanism of the post-process apparatus showing one embodiment of the invention.

As shown in FIG. 5, transverse alignment is executed by a transverse alignment mechanism 47 and a transverse alignment motor 48.

When a predetermined number of sheets are aligned and held on the processing tray 12, staple processing is carried out by the stapler 14.

Figure 6:
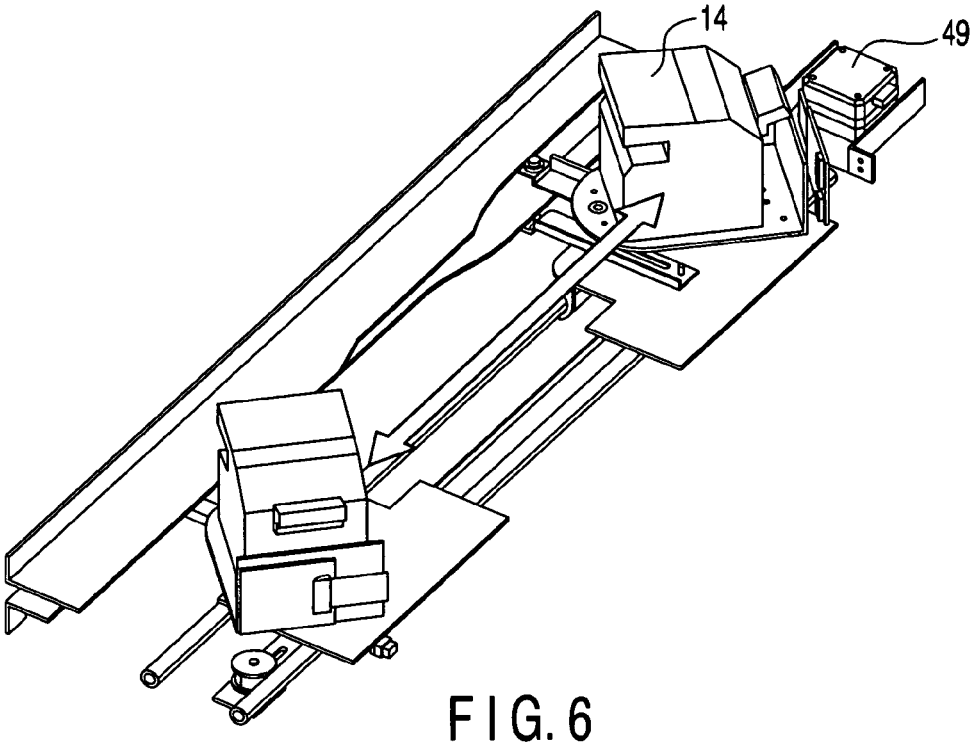
FIG. 6 is a view illustrating an operation of a stapler of the post-process apparatus showing one embodiment of the invention.
Figure 7:
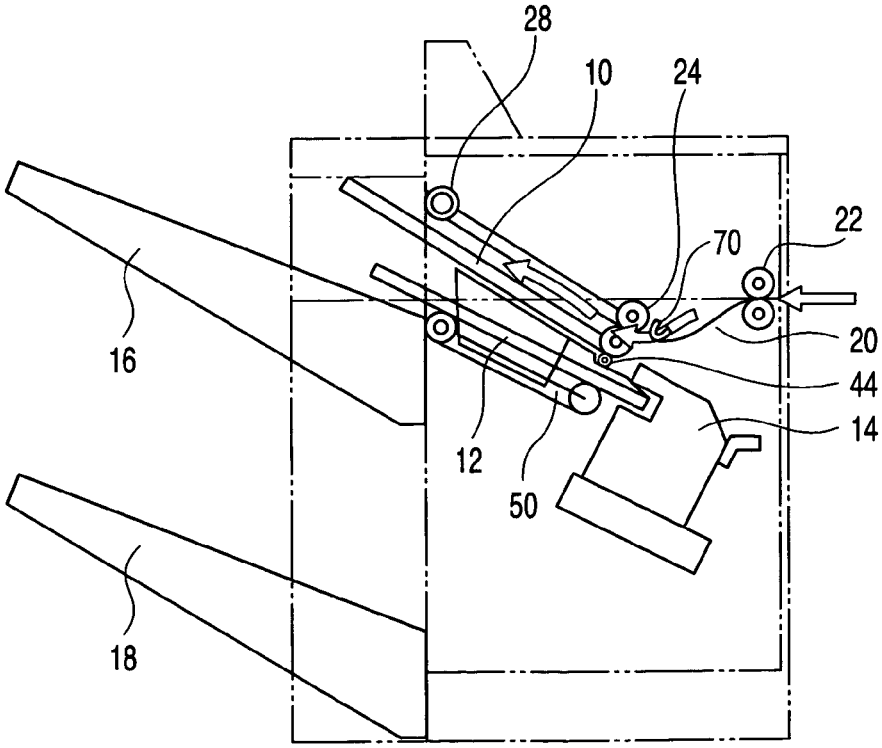
FIG. 7 is a view illustrating a flow of a first sheet of sheets between an inlet roller and a paper feed roller in the post-process apparatus showing one embodiment of the invention.
Figure 8:
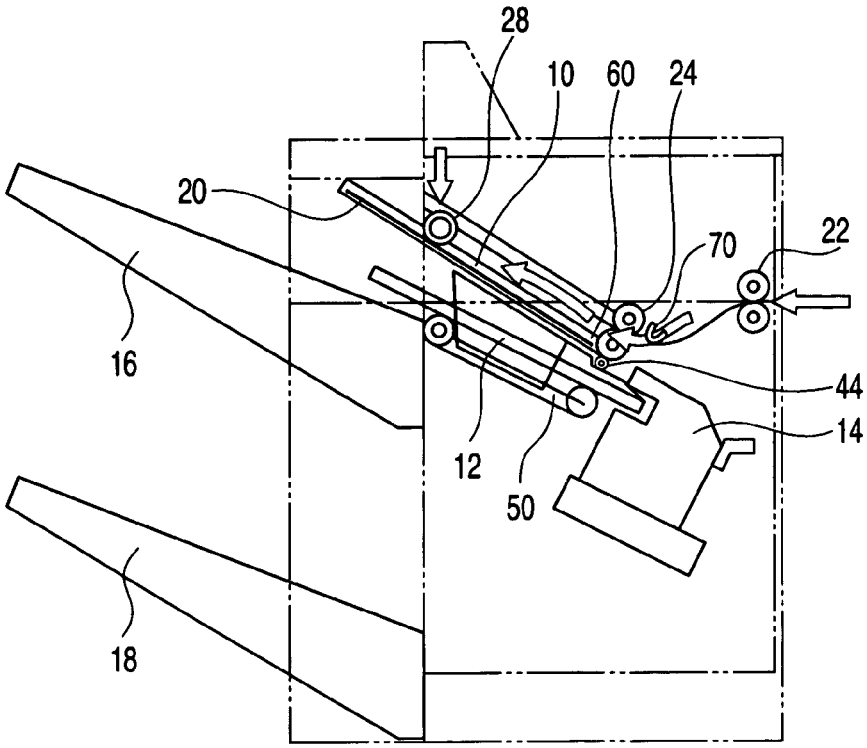
FIG. 8 is a view illustrating a flow of a first sheet of sheets between the paper feed roller and a standby roller in the post-process apparatus showing one embodiment of the invention.
Figure 9:
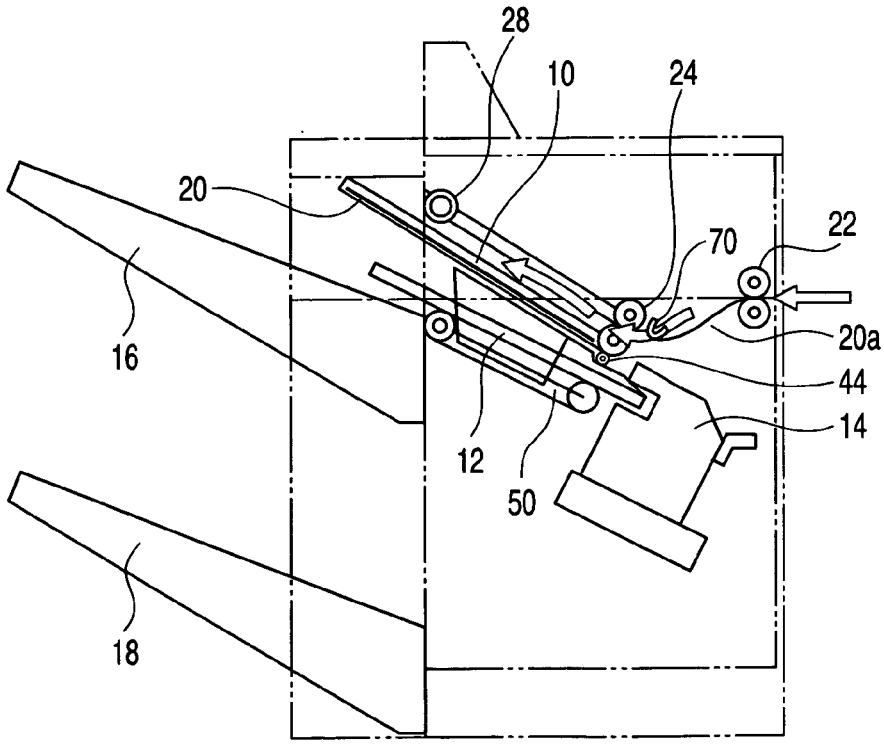
FIG. 9 is a view illustrating a flow of a second sheet of sheets between the paper feed roller and the standby roller in the post-process apparatus showing one embodiment of the invention.
Figure 10:
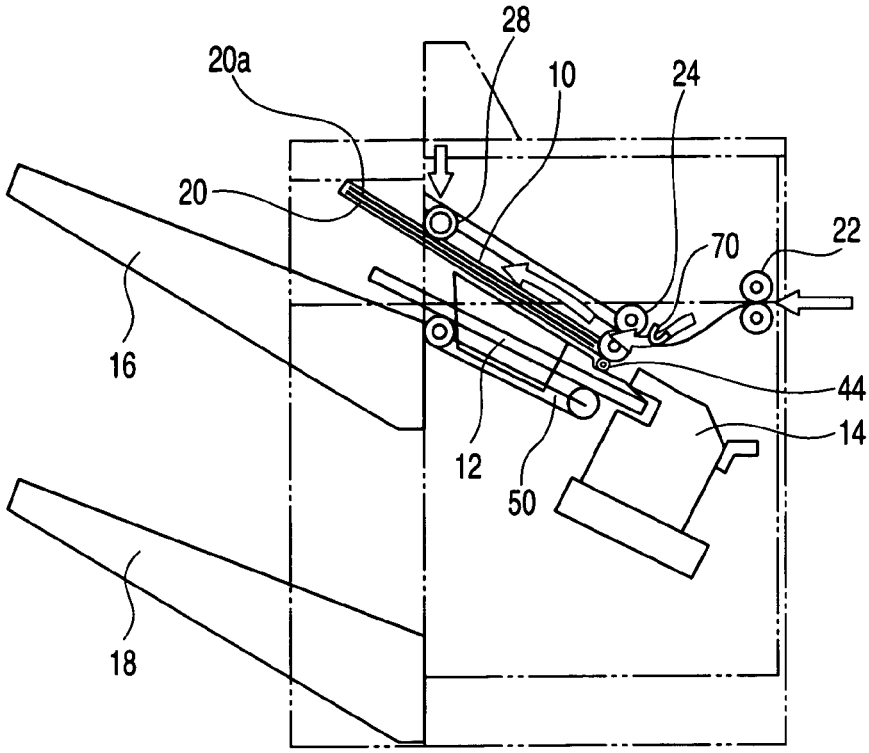
FIG. 10 is a view illustrating an operation of a waiting tray roller in the post-process apparatus showing one embodiment of the invention.

As shown in FIG. 6, the stapler 14 is positioned by a staple drive unit 49, and staple processing is controlled.

<Storage Tray>

As shown in FIG. 4, the staple processed bundles of sheets are sent to the storage tray 16 by the transport mechanism 50. Selection of the storage tray 16 or 18 is made by vertically moving the storage tray 16 or 18 by a storage tray drive unit 52.

In the case where sheets are directly ejected from the waiting tray 10, the storage tray is risen up to a location which corresponds to a sheet outlet of the waiting tray.

(Description of Operation)

Now, an operation of the post-process apparatus according to the present invention will be described with reference to FIGS. 7 to 17.

<Operation in Case Where Staple Processing is Carried Out>

As has been already described, staple processing on the processing tray is slow as compared with that on the image processing apparatus. Thus, when a sheet transported from the image processing apparatus is processed on the processing tray, a buffer unit is provided at the front stage thereof. Then, it is necessary to make a next sheet standby not so as to be transported to the processing tray until the staple processing on the processing tray has completed. In this example, a description will be given with respect to a case in which a bundle of three or more sheets is staple processed on the processing tray, and in which first and second sheets are made standby on the waiting tray, and the third and subsequent sheets are not required to be made standby.

A first sheet is transported from the image processing apparatus to the waiting tray 10 via the inlet roller 22 and the paper feed roller 24. The sheet is retained by the left and right lower face support members 10*a* and 10*b* and the distal end retainer member 74; the waiting tray roller 28 is lowered in this retained state, and a sheet distal end is aligned (this alignment is made with the distal end 60 of the waiting tray 10 (upstream side)).

Figure 11:
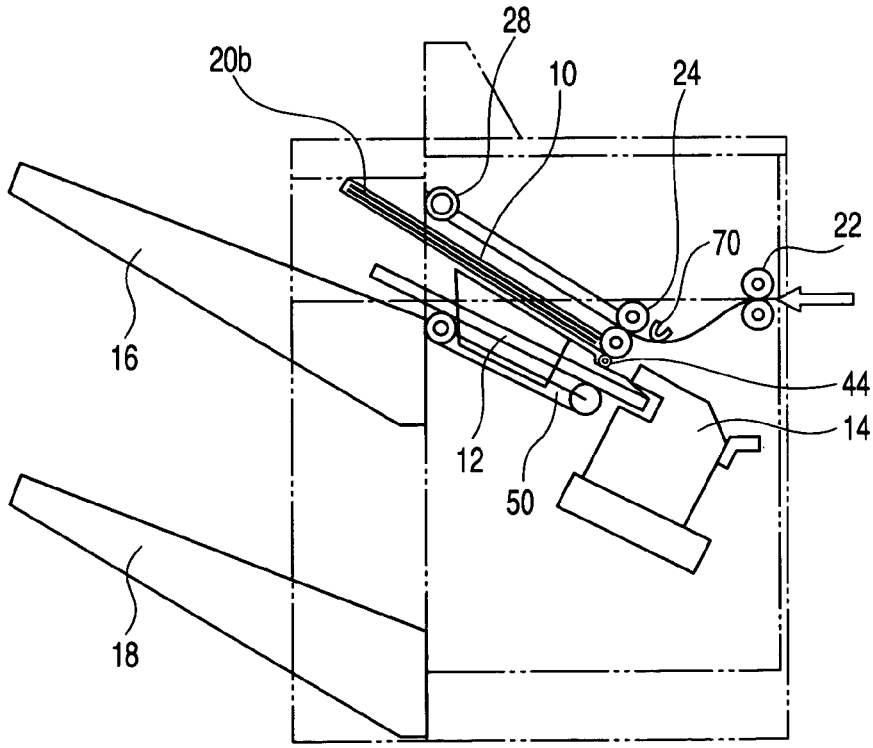
FIG. 11 is a view illustrating an operation of the waiting tray roller in the post-process apparatus showing one embodiment of the invention.
Figure 12:
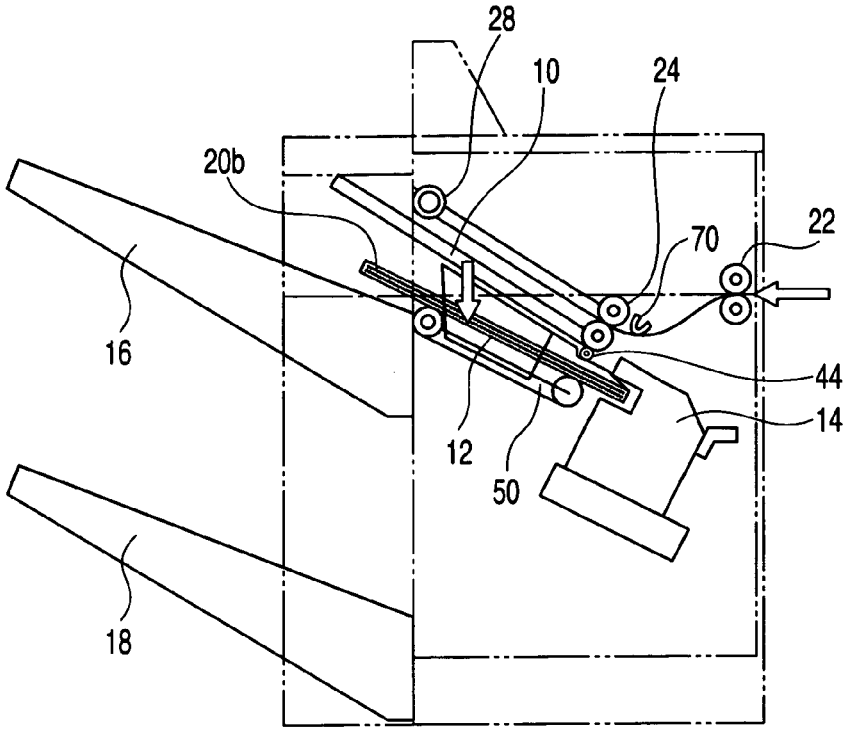
FIG. 12 is a view illustrating an operation of an active drop in the post-process apparatus showing one embodiment of the invention.

Next, the waiting tray roller 28 is risen, and is ready for accepting a second sheet 20*a*. When the second sheet 20*a* is sent to the waiting tray 10, the waiting tray roller 28 is lowered to align a location of the sheet with the distal end 60 of the waiting tray 10. Then, the waiting tray roller 28 is risen (FIG. 11). When the second sheet is transported to the waiting tray, the distal end portion of the sheet is sensed by the sheet sensor 70. When the first and second sheets are held on the waiting tray, these sheets are dropped onto the processing tray 12 altogether.

That is, the left and right lower face support members 10*a* and 10*b* are opened to release the support of both side faces of the sheet. At this time, the rotary shaft 72 is rotated at the same time. With this rotation, an operation of releasing the support of the distal end retainer member 74 and an operation of slashing the sheet distal end upper face by the upper face slash member 76 are carried out at the same time, and the sheet is forcibly dropped onto the processing tray. Next, the distal end in the transport direction of the sheet dropped in the processing tray 12 is aligned by the alignment paddle member 78. In this manner, the standby retention, retention release, and alignment processes can be carried out sequentially by rotating operation of one rotary shaft. After these processes have terminated, the rotary shaft 72 returns to its original location in which the sheet distal end is retained by the distal end retainer member 72.

Then, with respect to the third and subsequent sheets, the waiting tray is kept in a state in which the support of the sheet is released, and the sheet is transported from the paper feed roller 24 directly to the waiting tray.

Figure 13:
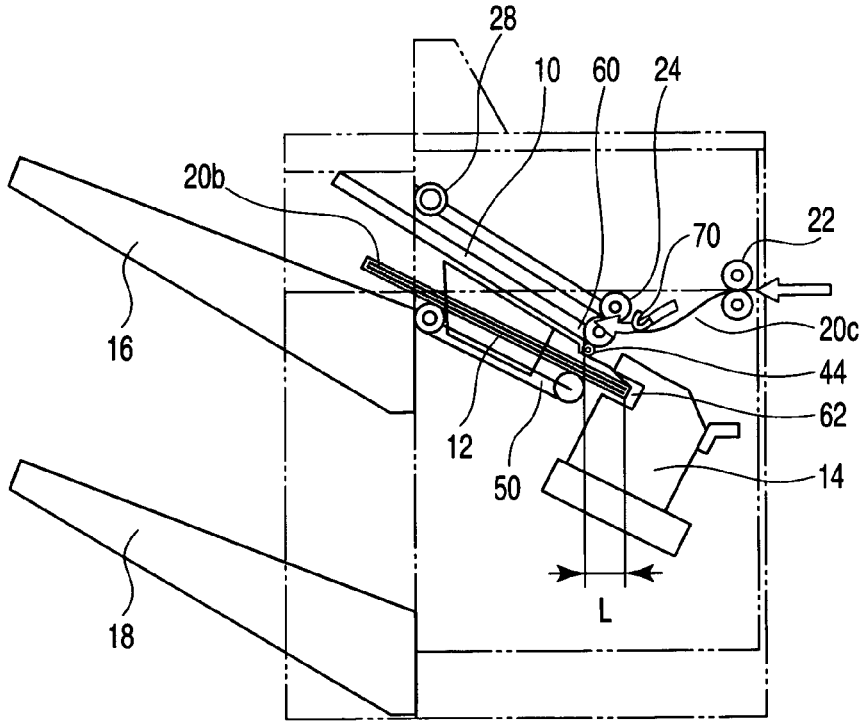
FIG. 13 is a view illustrating a flow of a third sheet of sheets in the post-process apparatus showing one embodiment of the invention.

In the processing tray 12, a predetermined number of bundles of sheets 21 are formed to be held on two bundles of sheets 20*b*. At this time, the longitudinal and transverse alignment mechanisms 38 and 47 function, and longitudinal and transverse sheet alignments are executed. At this time, as shown in FIG. 13, the distal end 60 of the waiting tray 10 and a distal end 62 (upstream side) of the processing tray 12 are spaced in a transverse direction with a distance L so that the distal end 60 of the waiting tray 10 exists on the downstream side more than the distal end 62 of the processing tray 12. With such a construction, the bundle of sheets 20*b* can be easily dropped from the waiting tray 10 to the processing tray 12, and an aligning operation using the longitudinal and transverse alignment mechanisms 38 and 47 can be easily made. As a result, an occurrence of jamming can be prevented.

The processing tray 12 is allocated to be obliquely inclined together with the waiting tray 10. Thus, the distal ends 60 and 62 of the respective trays are located at the lowest position, and the sheet 20 and the bundle of sheets 21 can be aligned with the distal ends 60 and 62 by its own weight of the sheet 20 and the bundle of sheets 21.

Figure 14:
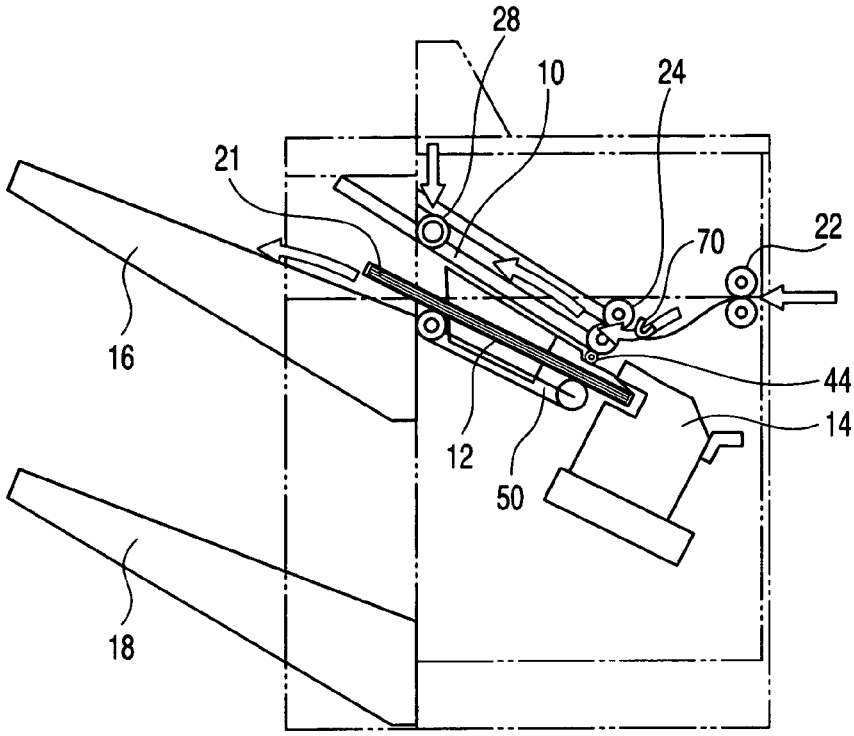
FIG. 14 is a view illustrating an operation of a stapler in the post-process apparatus showing one embodiment of the invention.
Figure 15:
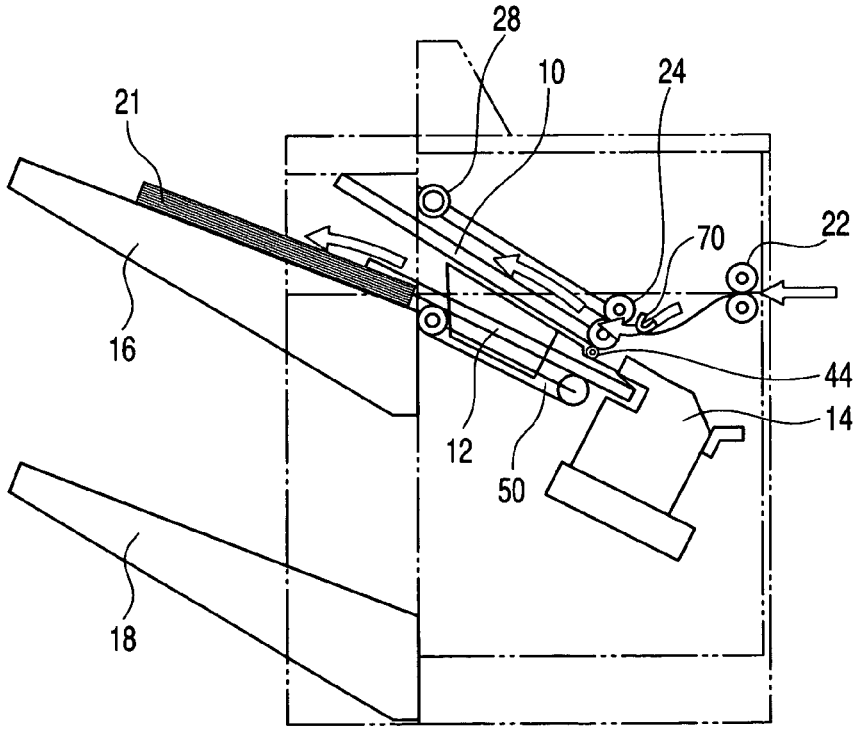
FIG. 15 is a view illustrating a flow of a bundle of sheets between a processing tray and a storage tray in the post-process apparatus showing one embodiment of the invention.

Next, as shown in FIG. 14, the bundle of sheets 21 is staple processed by the stapler 14. Then, as shown in FIG. 15, the bundle of sheets 20 is fed to the storage tray 16 by the transport mechanism 50, and post-process terminates.

<Processing in Case Where no Post-Process is Carried Out>

Figure 16:
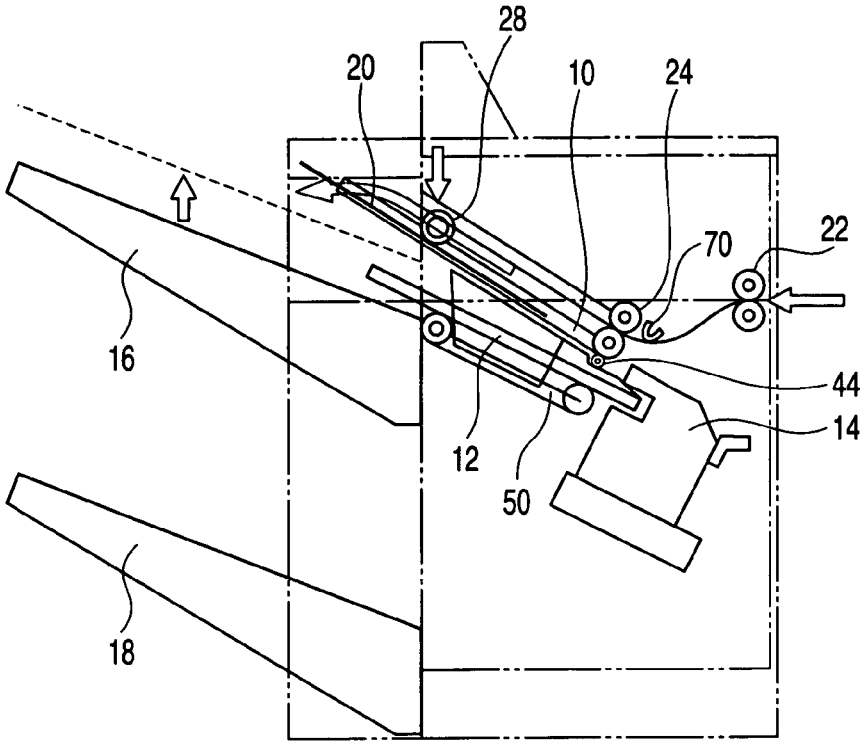
FIG. 16 is a view illustrating a flow of direct sheet ejection of a sheet from the waiting tray to the storage tray in the post-process apparatus showing one embodiment of the invention.
Figure 17:
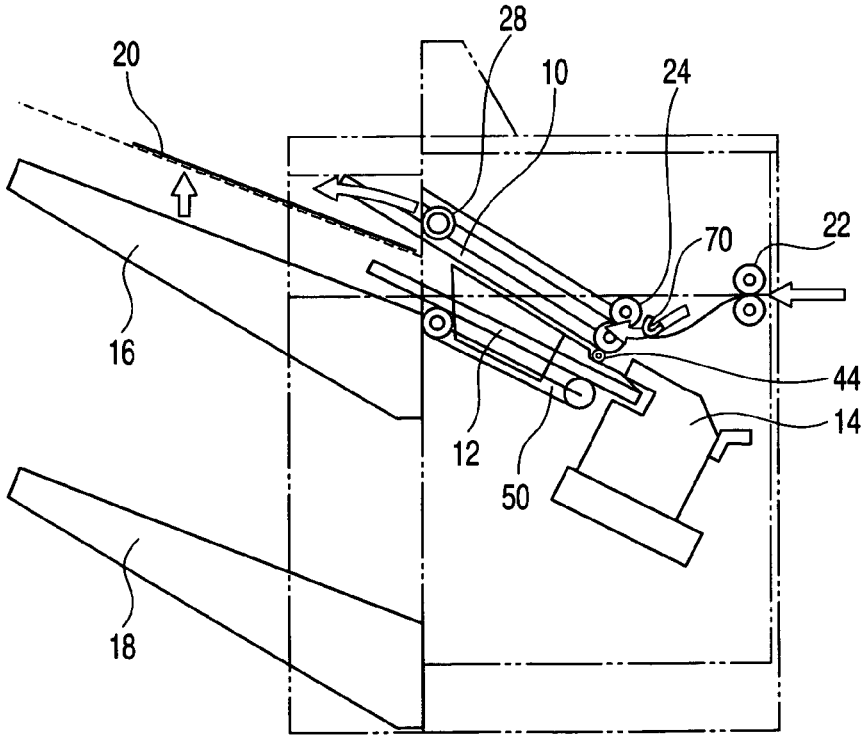
FIG. 17 is a view illustrating an operation of a position change of the storage tray in the post-process apparatus showing one embodiment of the invention.

In the case where no post-process is carried out (such as a case in which no staple processing is carried out or a case in which jamming occurs), as shown in FIGS. 16 and 17, a sheet is ejected from the waiting tray 10 directly to the storage tray 16 without intervening the processing tray 12. As shown in FIG. 16, the sheet fed from the image processing apparatus is fed to the storage tray 16 via the inlet roller 22, the paper feed roller 24, and the waiting tray 10. The waiting tray roller 28 is lowered to transport the sheet 20. The storage tray 16, as shown in FIG. 17, is slightly risen by the storage tray drive unit 52 to receive the sheet fed from the waiting tray 10.

Although the embodiments of the present invention have been described above, the present invention is not limited to the embodiments. Constituent elements shown in the embodiments can be changed to other constituent elements as long as they have same functions.

What is claimed is:

1. A sheet post-process apparatus, the apparatus comprising:

a waiting tray which temporarily retains a transported sheet in a waiting mode, and releases the retention to drop the sheet;

a processing tray which bundles sheets dropped from the waiting tray to carry out predetermined processing, and ejects the sheets; and a storage tray which holds the bundle of sheets processed and ejected on the processing tray, wherein the waiting tray comprises:

left and right lower face support members which support left and right lower faces in a sheet transport direction during retention in a waiting mode and release the support of the left and right lower faces during release of the retention;

a distal end lower face support member which supports a distal end lower face in a sheet transport direction during retention in a waiting mode and releases the support of the sheet distal end during release of the retention;

an upper face slash member which slashes a sheet distal end upper face in a processing tray direction during release of the retention; and a rotary shaft allocated in association with the distal end face in the transport direction of the sheet retained in a waiting mode, and the rotary shaft coaxially mounts the distal end upper face support member and the upper face slash member, and rotates the members, thereby moving the distal end lower face support member from a location for retention in a waiting mode to a location for releasing the retention and moving the upper face slash member to a location for slashing the sheet distal end upper face in the processing tray direction.

2. A sheet post-process apparatus according to claim 1, wherein the waiting tray further comprises an alignment paddle member which aligns a distal end of sheets held on the processing tray during sheet alignment on the processing tray, and the rotary shaft coaxially mounts the paddle member together with the distal end lower face support member and the upper face slash member, and rotates the members, thereby moving the distal end lower face support member from a location for retention in a waiting mode to a location for releasing the support and moving the upper face slash member to a location for slashing the sheet distal end upper face in the processing tray direction, and then moving the paddle member to a location for aligning the sheets.

3. A sheet post-process apparatus according to claim 1, wherein the waiting tray is allocated to be proximal to an upper stage of the processing tray, the processing tray and the waiting tray are allocated in an inclined shape which is high at a proximal end side of a sheet to be transported and which is low at a distal end side thereof, the processing tray and the waiting tray are short in length of a sheet transport direction thereof than a length of a standard sheet to be held, and a part of the proximal end side in the transport direction of the sheet held on the processing tray is held on the storage tray.

4. A waiting tray for use in a sheet post-process apparatus, for temporarily retaining a transported sheet in a waiting mode and releasing the support to drop the sheet onto a processing tray, the waiting tray comprising:

left and right lower face support members which support left and right lower faces in a sheet transport direction during retention in a waiting mode and release the support of the left and right lower faces during release of the retention;

a distal end lower face support member which supports a distal end lower face in a sheet transport direction during retention in a waiting mode and releases the support of the sheet distal end during release of the retention;

an upper face slash member which slashes a sheet distal end upper face in a processing tray direction during release of the retention; and a rotary shaft allocated in association with a distal end face in the transport direction of a sheet retained in a waiting mode, and the rotary shaft coaxially mounts the distal end upper face support member and the upper face slash member, and rotates the members, thereby moving the distal end lower face support member from a location for retention in a waiting mode to a location for releasing the retention and moving the upper face slash member to a location for slashing the sheet distal end upper face in the processing tray direction.

5. A waiting tray according to claim 4, further comprising: an alignment paddle member for aligning a distal end of sheets held on a processing tray during sheet alignment on the processing tray;

wherein the rotary shaft coaxially mount a paddle member together with the distal end lower face support member and the upper face slash member, and rotates the members, thereby moving the distal end lower face support member from a location for retention in a waiting mode to a location for releasing the support and moving the upper face slash member to a location for slashing the sheet distal end upper face in the processing tray direction, and then, moving the paddle member to a location for aligning the sheets, and then moving the paddle member to a location for aligning the sheets.

6. A waiting tray according to claim 5, wherein the paddle member is made of a soft elastic member, and in a location for aligning a sheet dropped onto the processing tray, the paddle member comes into contact with the upper face of the sheet in an elastically curved state, and aligns a distal end of the sheet to be pushed against a distal end side opposite to the transport direction.

7. A waiting tray according to claim 4, wherein the upper face slash member is made of a soft elastic member.

8. A sheet post-process apparatus, the apparatus comprising:

waiting means for temporarily retaining a transported sheet in a waiting mode, and releasing the retention to drop the sheet;

processing means for bundling sheets dropped from the waiting means to carry out predetermined processing, and ejecting the sheets; and storage means for holding the bundle of sheets processed and ejected on the processing means, wherein the waiting means comprises:

left and right lower face support means for supporting left and right lower faces in a sheet transport direction during retention in a waiting mode and releasing the support of the left and right lower faces during release of the retention;

distal end lower face support means for supporting a distal end lower face in a sheet transport direction during retention in a waiting mode and releasing the support of a sheet distal end during release of the retention;

upper face slash means for slashing a sheet distal end upper face in a processing means direction during release of the retention; and a rotary shaft allocated in association with a distal end face in the transport direction of a sheet retained in a waiting mode, and the rotary shaft coaxially mounts the distal end upper face support means and the upper face slash means, and rotates the means, thereby moving the distal end lower face support means from a location for retention in a waiting mode to a location for releasing the retention and moving the upper face slash means to a location for slashing the sheet distal end upper face in the processing means direction.

9. A sheet post-process apparatus according to claim 8, wherein the waiting means further comprises alignment means for aligning a distal end of sheets held on the processing means during sheet alignment on the processing means, and the rotary shaft coaxially mounts the alignment means together with the distal end lower face support means and the upper face slash means, and rotates the means, thereby moving the distal end lower face support means from a location for retention in a waiting mode to a location for releasing the support and moving the upper face slash means to a location for slashing the sheet distal end upper face in the processing means direction, and then, moving the alignment means to a location for aligning the sheets.

* * * * *